US009506008B2

(12) United States Patent
Gaal et al.

(10) Patent No.: US 9,506,008 B2
(45) Date of Patent: Nov. 29, 2016

(54) METHOD FOR IMPROVING ENGINE FUEL EFFICIENCY

(71) Applicants: Dennis A. Gaal, Glassboro, NJ (US); Erik Herz, Brookhaven, PA (US); Mrugesh Nilesh Patel, Philadelphia, PA (US); Douglas Edward Deckman, Mullica Hill, NJ (US); Smruti A. Dance, Robbinsville, NJ (US)

(72) Inventors: Dennis A. Gaal, Glassboro, NJ (US); Erik Herz, Brookhaven, PA (US); Mrugesh Nilesh Patel, Philadelphia, PA (US); Douglas Edward Deckman, Mullica Hill, NJ (US); Smruti A. Dance, Robbinsville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 55 days.

(21) Appl. No.: 14/219,300

(22) Filed: Mar. 19, 2014

(65) Prior Publication Data

US 2015/0175925 A1 Jun. 25, 2015

Related U.S. Application Data

(60) Provisional application No. 61/920,120, filed on Dec. 23, 2013.

(51) Int. Cl.
*C10M 139/00* (2006.01)
*C10M 141/08* (2006.01)

(52) U.S. Cl.
CPC ..... *C10M 141/08* (2013.01); *C10M 2207/283* (2013.01); *C10M 2219/044* (2013.01)

(58) Field of Classification Search
CPC ..... C10M 129/70; C10M 129/72
USPC ..... 508/198
See application file for complete search history.

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 1/1981
EP 464546 A1 8/1992
(Continued)

OTHER PUBLICATIONS

The International Search Report and Written Opinion of PCT/US2014/032474 dated Aug. 12, 2014.

*Primary Examiner* — Prem C Singh
*Assistant Examiner* — Francis C Campanell
(74) *Attorney, Agent, or Firm* — Robert A. Migliorini; Jerry Coon

(57) ABSTRACT

A method for improving fuel efficiency and reducing frictional properties, while maintaining or improving deposit control, in an engine lubricated with a lubricating oil by using as the lubricating oil a formulated oil. The formulated oil has a composition including a lubricating oil base stock as a major component, and a combination of (i) a friction modifier mixture and (ii) a detergent, as a minor component. Fuel efficiency and friction reduction properties are improved and deposit control is maintained or improved as compared to friction reduction properties and deposit control achieved using a lubricating engine oil containing a minor component other than the combination of the friction modifier mixture and detergent. A lubricating engine oil having a composition including a lubricating oil base stock as a major component, and a combination of (i) a friction modifier mixture and (ii) a detergent, as a minor component.

4 Claims, 15 Drawing Sheets

| | Inventive Ex. 1 | Comp. Ex.26 | Inventive Ex.9 | Inventive Ex. 10 | Comp Ex. 27 | Comp. Ex. 28 | Comp. Ex. 29 |
|---|---|---|---|---|---|---|---|
| Base Stock (Group IIIA, IV, V) | 84.58 | 85.91 | 85.51 | 84.01 | 85.51 | 84.11 | 85.16 |
| Remainder of Formulation | 10.14 | 9.74 | 9.74 | 9.74 | 9.74 | 9.74 | 9.74 |
| Detergent 4 | 2.63 | 3.10 | 3.00 | 2.50 | 3.00 | 2.40 | 2.75 |
| Detergent 1 | 2.00 | **0.50** | **1.00** | **3.00** | 0.00 | 0.00 | 2.00 |
| Detergent 2 | 0.00 | 0.00 | 0.00 | 0.00 | **1.00** | **3.00** | 0.00 |
| Organic FM 1 | 0.50 | 0.50 | 0.50 | 0.50 | 0.50 | 0.50 | **0.10** |
| Organic FM 3 | 0.25 | 0.25 | 0.25 | 0.25 | 0.25 | 0.25 | 0.25 |
| KV@100°C | 7.54 | 7.56 | 7.62 | 7.62 | 7.61 | 7.61 | 7.58 |
| MTM@140°C | 0.046 | 0.08 | 0.066 | 0.091 | 0.155 | 0.215 | 0.209 |
| TEOST 33C | 14 | 28 | 16 | 9 | 13 | 12 | 7 |

| | Inventive Ex. 11 | Inventive Ex. 12 | Inventive Ex. 13 | Comp. Ex. 30 | Comp. Ex. 31 |
|---|---|---|---|---|---|
| Base Stock (Group IIIA, IV, V) | 85.01 | 84.31 | 84.91 | 84.51 | 84.26 |
| Remainder of Formulation | 9.74 | 9.74 | 9.74 | 9.74 | 9.74 |
| Detergent 4 | 2.75 | 2.75 | 2.75 | 2.75 | 2.75 |
| Detergent 1 | 2.00 | 2.00 | 2.00 | 2.00 | 2.00 |
| Detergent 2 | 0.00 | 0.00 | 0.00 | 0.00 | 0.00 |
| Organic FM 1 | **0.25** | **0.75** | 0.50 | 0.50 | 0.50 |
| Organic FM 3 | 0.25 | 0.25 | **0.10** | **0.50** | **0.75** |
| KV@100°C | 7.63 | - | - | 7.48 | - |
| MTM@140°C | 0.113 | 0.088 | 0.071 | 0.198 | 0.192 |
| TEOST 33C | 8 | 8 | 7 | 8 | 8 |

(56) References Cited

U.S. PATENT DOCUMENTS

| | | | |
|---|---|---|---|
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Koome et al. |
| 3,036,003 | A | 5/1962 | Verdol |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | LeSuer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman ei al. |
| 3,449,250 | A | 6/1969 | Fields |
| 3,454,555 | A | 7/1969 | van der Voort et al. |
| 3,454,607 | A | 7/1969 | LeSuer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Plasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piesek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,266,945 | A | 5/1981 | Karn |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,529,526 | A | 7/1985 | Inoue et al. |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,904,401 | A | 2/1990 | Ripple et al. |
| 4,910,355 | A | 3/1990 | Shubkin et al. |
| 4,921,594 | A | 5/1990 | Miller |
| 4,943,672 | A | 7/1990 | Hamner et al. |
| 4,956,122 | A | 9/1990 | Watts et al. |
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Galic et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 7,704,930 | B2 | 4/2010 | Deckman et al. |
| 8,048,833 | B2 | 11/2011 | Habeeb et al. |
| 2004/0214731 | A1 | 10/2004 | Tynik |
| 2006/0229215 | A1 | 10/2006 | Burrington et al. |
| 2007/0042917 | A1 | 2/2007 | Ravichandran et al. |
| 2008/0221000 | A1 | 9/2008 | Chase et al. |
| 2009/0048130 | A1 | 2/2009 | Habeeb et al. |
| 2011/0077178 | A1 | 3/2011 | Chase et al. |
| 2011/0287990 | A1* | 11/2011 | Farng ..... C10M 141/12 508/186 |
| 2012/0129743 | A1* | 5/2012 | Suen ..... C10M 141/06 508/198 |

FOREIGN PATENT DOCUMENTS

| | | |
|---|---|---|
| EP | 464547 A1 | 8/1992 |
| EP | 471071 B1 | 8/1995 |
| EP | 1757673 | 2/2007 |
| EP | 2248878 | 11/2010 |
| GB | 1429494 | 4/1972 |
| GB | 1350257 | 4/1974 |
| GB | 1390359 | 4/1975 |
| GB | 1440230 | 6/1976 |
| WO | 03064570 | 8/2003 |

* cited by examiner

Fig. 1

| | Baseline 1 | Comp. Example 1 | Comp. Example 2 | Comp. Example 3 | Comp. Example 4 | Comp. Example 5 | Comp. Example 6 |
|---|---|---|---|---|---|---|---|
| Base Stock (Group IIIA, IV, V) | 87.4 | 86.4 | 86.4 | 86.4 | 86.4 | 86.4 | 86.4 |
| Other Additives (constant) | 12.6 | 12.6 | 12.6 | 12.6 | 12.6 | 12.6 | 12.6 |
| Detergent 1 | | 1.0 | | | | | |
| Detergent 2 | | | 1.0 | | | | |
| Detergent 3 | | | | 1.0 | | | |
| Organic FM 1 | | | | | 1.0 | | |
| Organic FM 2 | | | | | | 1.0 | |
| Organic FM 3 | | | | | | | 1.0 |
| Organic FM 4 | | | | | | | |
| Organic FM 5 | | | | | | | |
| Organic Metallic FM 1 | | | | | | | |
| Organic Metallic FM 2 | | | | | | | |
| Organic Metallic FM 3 | | | | | | | |
| Organic Metallic FM 4 | | | | | | | |
| Test Results | | | | | | | |
| KV@100°C | 6.69 | 6.76 | 6.73 | 6.76 | 6.99 | 6.62 | 6.70 |
| HTHS@150°C | 2.21 | 2.24 | 2.23 | 2.21 | 2.32 | 2.19 | 2.21 |
| MTM@140°C | 0.180 | 0.186 | 0.148 | 0.162 | 0.170 | 0.179 | 0.188 |
| TEOST 33C | 66 | 19 | 13 | 67 | 64 | 13 | 38 |

Fig. 1 (Cont.)

| | Comp. Example 7 | Comp. Example 8 | Comp. Example 9 | Comp. Example 10 | Comp. Example 11 | Comp. Example 12 |
|---|---|---|---|---|---|---|
| Base Stock (Group IIIA, IV, V) | 86.4 | 86.4 | 86.4 | 86.4 | 86.4 | 86.4 |
| Other Additives (constant) | 12.6 | 12.6 | 12.6 | 12.6 | 12.6 | 12.6 |
| Detergent 1 | | | | | | |
| Detergent 2 | | | | | | |
| Detergent 3 | | | | | | |
| Organic FM 1 | | | | | | |
| Organic FM 2 | | | | | | |
| Organic FM 3 | | | | | | |
| Organic FM 4 | 1.0 | | | | | |
| Organic FM 5 | | 1.0 | | | | |
| Organic Metallic FM 1 | | | 1.0 | | | |
| Organic Metallic FM 2 | | | | 1.0 | | |
| Organic Metallic FM 3 | | | | | 1.0 | |
| Organic Metallic FM 4 | | | | | | 1.0 |
| Test Results | | | | | | |
| KV@100°C | 6.71 | 6.67 | 6.66 | 6.76 | 6.73 | 6.73 |
| HTHS@150°C | 2.22 | 2.24 | 2.22 | 2.21 | 2.23 | 2.25 |
| MTM@140°C | 0.191 | 0.151 | 0.200 | 0.159 | 0.177 | 0.119 |
| TEOST 33C | 69 | 17 | 43 | 87 | -- | 80 |

Fig. 2

| | Baseline 1 | Baseline 2 | Inventive Example 1 | Inventive Example 2 | Inventive Example 3 | Inventive Example 4 |
|---|---|---|---|---|---|---|
| Base Stock (Group IV, V) | 57.4 | 56.58 | 54.58 | 54.78 | 54.74 | 53.41 |
| Group IIIA | 30.0 | | 30.0 | 30.0 | 30.0 | 30.0 |
| Group IIIB | | 30.0 | | | | |
| Other Additives | 11.1 | 11.32 | 9.54 | 9.54 | 9.54 | 9.54 |
| Organic FM 1 | | | 0.5 | 0.5 | 0.5 | 0.5 |
| Organic FM 3 | | | 0.25 | 0.25 | 0.25 | 0.25 |
| Organic FM 5 | | 0.5 | | | | |
| Detergent 1 | | | 2.0 | 2.0 | 2.0 | 2.0 |
| Detergent 3 | | | | | | 2.0 |
| Detergent 4 | 1.5 | 1.5 | 2.63 | 2.73 | 2.77 | 2.1 |
| Organic Metallic FM 1 | | | | | 0.2 | |
| Organic Metallic FM 4 | | 0.1 | 0.5 | 0.2 | | 0.2 |
| Test Results | | | | | | |
| KV@100°C | 6.69 | 7.43 | 7.64 | 7.62 | 7.61 | 7.75 |
| MTM@140°C | 0.180 | 0.216 | 0.046 | 0.049 | 0.048 | 0.124 |
| TEOST 33C | 66 | 13.3 | 14 | 6 | 5 | 10 |

Fig. 2 (Cont.)

| | Comp. Example 13 | Comp. Example. 14 | Comp. Example 15 | Comp. Example 16 |
|---|---|---|---|---|
| Base Stock (Group IV, V) | 54.82 | 53.1 | 54.74 | 52.87 |
| Group IIIA | 30.0 | 30.0 | 30.0 | 30.0 |
| Group IIIB | | | | |
| Other Additives | 9.54 | 9.54 | 9.54 | 9.54 |
| Organic FM 1 | 0.5 | 0.5 | 0.5 | 0.5 |
| Organic FM 3 | | 0.25 | 0.25 | 0.25 |
| Organic FM 5 | | | | |
| Detergent 1 | 2.0 | 4.0 | | |
| Detergent 3 | | | 2.0 | 5.0 |
| Detergent 4 | 2.63 | 2.11 | 2.77 | 1.64 |
| Organic Metallic FM 1 | | | 0.2 | 0.2 |
| Organic Metallic FM 4 | 0.5 | 0.5 | | |
| Test Results | | | | |
| KV@100°C | 7.65 | 7.84 | 7.53 | 7.72 |
| MTM@140°C | 0.177 | 0.084 | 0.133 | 0.163 |
| TEOST 33C | 20 | 30 | 49 | 36 |

Fig. 3

| | Inventive Example 3 | Inventive Example 5 |
|---|---|---|
| Base Stock (Group III, IV, V) | 84.74 | 84.74 |
| Constant Additives | 9.31 | 9.31 |
| Organic FM 1 | 0.5 | 0.35 |
| Organic FM 3 | 0.25 | 0.25 |
| Detergent 1 | 2.0 | 2.0 |
| Organic Metallic FM 1 | 0.2 | 0.1 |
| Viscosity Modifier | 3.0 | 2.5 |
| Antioxidant 1 | 0.0 | 0.75 |
| Test Results | | |
| KV@100°C | 7.61 | 7.24 |
| HTHS@150°C | 2.44 | 2.43 |
| MTM@140°C | 0.048 | 0.095 |
| TEOST 33C | 5 | 7 |
| Seq. IIIG (WPD Merit) | - | 5.6 |
| Seq. VID (FEI Sum) | - | 4.1 |

Fig. 4

| | Baseline 3 | Comp. Example 17 |
|---|---|---|
| Base Stock (Group IV) | 56.05 | 53.29 |
| Group IIIA | 30.0 | |
| Group IIIB | | 30.0 |
| Viscosity Modifier | 3.1 | 5.0 |
| Other Additives | 7.93 | 7.96 |
| Detergent 2 | 0.0 | 0.75 |
| Detergent 4 | 2.92 | 3.0 |
| Test Results | | |
| KV@100°C | 7.35 | 8.79 |
| HTHS@150°C | 2.32 | 2.70 |
| MTM@140°C | 0.158 | 0.186 |
| TEOST 33C | 38 | 10 |
| Seq. IIIG (WPD Merit) | 4.3 | 5.8 |

Fig. 5

| | Comp. Ex 18 | Inventive Ex. 6 | | Comp. Ex. 19 | Inventive Ex. 7 | | Comp. Ex. 20 | Inventive Ex. 8 |
|---|---|---|---|---|---|---|---|---|
| Remainder of Formulation | 93.36 | 94.75 | | 96.28 | 94.75 | | 96.28 | 94.75 |
| **Detergents** | | | | | | | | |
| Detergent 1 | | 2.0 | | | 2.0 | | | 2.0 |
| Detergent 3 | 4.0 | | | | | | | |
| Detergent 4 | 2.04 | 2.65 | | 3.12 | 2.65 | | 3.12 | 2.65 |
| | | | | | | | | |
| **Organic FM** | | | | | | | | |
| Organic FM 1 | | | | 0.3 | 0.3 | | | |
| Organic FM 3 | | | | | | | 0.3 | 0.3 |
| Organic FM 4 | 0.3 | 0.3 | | 0.3 | 0.3 | | 0.3 | 0.3 |
| Organic FM 5 | 0.3 | 0.3 | | | | | | |
| | | | | | | | | |
| TEOST 33C | 27 | 11 | | 58 | 7 | | 59 | 5 |

Fig. 6

| Comparative Examples | 21 | 22 | 23 |
|---|---|---|---|
| Base Stock (Group IIIA, IV, V) | 87.29 | 86.54 | 86.54 |
| Remainder of Formulation | 12.71 | 12.71 | 12.71 |
| Phenolic AO1 | | 0.75 | |
| Phenolic AO2 | | | 0.75 |
| Test Results | | | |
| KV@100°C | 7.31 | 7.39 | 7.34 |
| HTHS@150°C | 2.31 | 2.33 | 2.28 |
| MTM@140°C | 0.280 | 0.280 | 0.280 |
| TEOST 33C | 21 | 19 | 18 |

Fig. 8

| Comparative Examples | 24 | 25 |
|---|---|---|
| Group IIIA | 30.0 | |
| Group IIIB | | 30.0 |
| Remainder of Formulation | 70.0 | 70.0 |
| Test Results | | |
| KV@100°C | 7.39 | 7.43 |
| HTHS@150°C | 2.34 | 2.35 |
| MTM@140°C | 0.281 | 0.216 |
| TEOST 33C | 19 | 13 |

Fig. 9

| | Inventive Ex. 1 | Comp. Ex.26 | Inventive Ex.9 | Inventive Ex. 10 | Comp. Ex. 27 | Comp. Ex. 28 | Comp. Ex. 29 |
|---|---|---|---|---|---|---|---|
| Base Stock (Group IIIA, IV, V) | 84.58 | 85.91 | 85.51 | 84.01 | 85.51 | 84.11 | 85.16 |
| Remainder of Formulation | 10.04 | 9.74 | 9.74 | 9.74 | 9.74 | 9.74 | 9.74 |
| Detergent 4 | 2.63 | 3.10 | 3.00 | 2.50 | 3.00 | 2.40 | 2.75 |
| Detergent 1 | 2.00 | **0.50** | **1.00** | **3.00** | 0.00 | 0.00 | 2.00 |
| Detergent 2 | 0.00 | 0.00 | 0.00 | 0.00 | **1.00** | **3.00** | 0.00 |
| Organic FM 1 | 0.50 | 0.50 | 0.50 | 0.50 | 0.50 | 0.50 | **0.10** |
| Organic FM 3 | 0.25 | 0.25 | 0.25 | 0.25 | 0.25 | 0.25 | 0.25 |
| | | | | | | | |
| KV@100°C | 7.64 | 7.56 | 7.62 | 7.82 | 7.61 | 7.81 | 7.58 |
| MTM@140°C | 0.046 | 0.08 | 0.066 | 0.091 | 0.185 | 0.215 | 0.209 |
| TEOST 33C | 14 | 28 | 16 | 9 | 13 | 12 | 7 |

Fig. 9 (Cont.)

| | Inventive Ex. 11 | Inventive Ex. 12 | Inventive Ex. 13 | Comp. Ex. 30 | Comp. Ex. 31 |
|---|---|---|---|---|---|
| Base Stock (Group IIIA, IV, V) | 85.01 | 84.51 | 84.91 | 84.51 | 84.26 |
| Remainder of Formulation | 9.74 | 9.74 | 9.74 | 9.74 | 9.74 |
| Detergent 4 | 2.75 | 2.75 | 2.75 | 2.75 | 2.75 |
| Detergent 1 | 2.00 | 2.00 | 2.00 | 2.00 | 2.00 |
| Detergent 2 | 0.00 | 0.00 | 0.00 | 0.00 | 0.00 |
| Organic FM 1 | **0.25** | **0.75** | 0.50 | 0.50 | 0.50 |
| Organic FM 3 | 0.25 | 0.25 | **0.10** | **0.50** | **0.75** |
| | | | | | |
| KV@100°C | 7.63 | - | - | 7.48 | - |
| MTM@140°C | 0.113 | 0.088 | 0.071 | 0.168 | 0.192 |
| TEOST 33C | 8 | 8 | 7 | 8 | 8 |

Fig. 10

| Examples | 32 | 33 | 34 | 35 | 36 | 37 | 38 | 39 | 40 | 41 | 42 | 43 |
|---|---|---|---|---|---|---|---|---|---|---|---|---|
| **Formulation Components** | | | | | | | | | | | | |
| Petroleum derived calcium sulfonate | 2.0 | 2.0 | 2.0 | 2.0 | 2.0 | 2.0 | 2.0 | 2.0 | 2.0 | 2.0 | 2.0 | 2.0 |
| Ethoylated fatty acid ester | 0.5 | 0.5 | 0.5 | 0.5 | 0.5 | 0.5 | 0.5 | 0.5 | 0.5 | 0.5 | 0.5 | 0.5 |
| Glycerol fatty acid ester | 0.25 | 0.25 | 0.25 | 0.25 | 0.25 | 0.25 | 0.25 | 0.25 | 0.25 | 0.25 | 0.25 | 0.25 |
| Molybdenum containing compounds | 0.0 | 0.2 | 0.5 | 1.0 | 0.0 | 0.2 | 0.5 | 1.0 | 0.0 | 0.2 | 0.5 | 1.0 |
| Mg sulfonate | 0.0 | 0.0 | 0.3 | 1.0 | 2.0 | 1.0 | 2.0 | 1.0 | 2.0 | 0.5 | 0.5 | 1.0 |
| Mg and/or Ca salicylates | 0.0 | 0.3 | 0.0 | 0.0 | 0.0 | 1.0 | 1.0 | 2.0 | 2.0 | 0.5 | 1.0 | 0.5 |
| Borated and/or non-borated succimidaes | 5.0 | 5.0 | 5.0 | 5.0 | 5.0 | 5.0 | 5.0 | 5.0 | 5.0 | 5.0 | 5.0 | 5.0 |
| Diaklyl or diaryl amines | 0.8 | 0.8 | 0.8 | 0.8 | 0.5 | 0.5 | 0.5 | 0.5 | 0.8 | 0.8 | 0.8 | 0.8 |
| Phenolic derivatives | 0.8 | 0.8 | 0.8 | 0.8 | 0.8 | 0.8 | 0.8 | 0.8 | 0.5 | 0.5 | 0.5 | 0.5 |
| Olefin-based polymers (block, star, and/or mixed) | 2.0 | 2.0 | 2.0 | 2.0 | 2.0 | 2.0 | 2.5 | 2.5 | 2.5 | 2.5 | 2.5 | 2.5 |
| Polymethacrylates | 0.3 | 0.3 | 0.3 | 0.3 | 0.3 | 0.3 | 0.1 | 0.1 | 0.1 | 0.1 | 0.1 | 0.1 |
| Fumnarate vinyl-acetate-based polymers | 0.1 | 0.1 | 0.1 | 0.1 | 0.1 | 0.1 | 0.3 | 0.3 | 0.3 | 0.3 | 0.3 | 0.3 |
| Zinc dialkyl dithiophosphate (1°, 2° and/or mixed) | 0.0 | 0.0 | 0.0 | 0.0 | 0.3 | 0.3 | 0.3 | 0.3 | 0.8 | 0.8 | 0.8 | 0.8 |
| Base Stocks (Group I, II, III, IV, V) | 95.4 | 94.9 | 94.6 | 93.4 | 93.3 | 93.1 | 91.8 | 86.3 | 84.8 | 87.6 | 86.8 | 86.3 |

Fig. 11

| Examples | 44 | 45 | 46 | 47 | 48 | 49 | 50 | 51 | 52 | 53 | 54 | 55 |
|---|---|---|---|---|---|---|---|---|---|---|---|---|
| **Formulation Components** | | | | | | | | | | | | |
| Petroleum derived calcium sulfonate | 2.0 | 2.0 | 2.0 | 2.0 | 2.0 | 2.0 | 2.0 | 2.0 | 2.0 | 2.0 | 2.0 | 2.0 |
| Ethoylated fatty acid ester | 0.5 | 0.5 | 0.5 | 0.5 | 0.5 | 0.5 | 0.5 | 0.5 | 0.5 | 0.5 | 0.5 | 0.5 |
| Glycerol fatty acid ester | 0.25 | 0.25 | 0.25 | 0.25 | 0.25 | 0.25 | 0.25 | 0.25 | 0.25 | 0.25 | 0.25 | 0.25 |
| Molybdenum containing compounds | 0.0 | 0.2 | 0.5 | 1.0 | 0.0 | 0.2 | 0.5 | 1.0 | 0.0 | 0.2 | 0.5 | 1.0 |
| Mg sulfonate | 0.0 | 0.0 | 0.3 | 1.0 | 2.0 | 1.0 | 2.0 | 1.0 | 2.0 | 0.5 | 0.5 | 1.0 |
| Mg and/or Ca salicylates | 0.0 | 0.3 | 0.0 | 0.0 | 0.0 | 1.0 | 1.0 | 2.0 | 2.0 | 0.5 | 1.0 | 0.5 |
| Borated and/or non-borated succimidaes | 5.0 | 5.0 | 5.0 | 5.0 | 5.0 | 5.0 | 5.0 | 5.0 | 5.0 | 5.0 | 5.0 | 5.0 |
| Diaklyl or diaryl amines | 0.8 | 0.8 | 0.8 | 0.8 | 0.5 | 0.5 | 0.5 | 0.5 | 0.8 | 0.8 | 0.8 | 0.8 |
| Phenolic derivatives | 0.8 | 0.8 | 0.8 | 0.8 | 0.8 | 0.8 | 0.8 | 0.8 | 0.5 | 0.5 | 0.5 | 0.5 |
| Olefin-based polymers (block, star, and/or mixed) | 1.0 | 1.0 | 1.0 | 1.0 | 1.0 | 1.0 | 1.5 | 1.5 | 1.5 | 1.5 | 1.5 | 1.5 |
| Polymethacrylates | 0.3 | 0.3 | 0.3 | 0.3 | 0.3 | 0.3 | 0.1 | 0.1 | 0.1 | 0.1 | 0.1 | 0.1 |
| Fumnarate vinyl-acetate-based polymers | 0.1 | 0.1 | 0.1 | 0.1 | 0.1 | 0.1 | 0.3 | 0.3 | 0.3 | 0.3 | 0.3 | 0.3 |
| Zinc dialkyl dithiophosphate (1°, 2° and/or mixed) | 0.0 | 0.0 | 0.0 | 0.0 | 0.3 | 0.3 | 0.3 | 0.3 | 0.8 | 0.8 | 0.8 | 0.8 |
| Base Stocks (Group I, II, III, IV, V) | 95.4 | 94.9 | 94.6 | 93.4 | 93.3 | 93.1 | 91.8 | 86.3 | 84.8 | 87.6 | 86.8 | 86.3 |

Fig. 12

| Examples | 56 | 57 | 58 | 59 | 60 | 61 | 62 | 63 | 64 | 65 | 66 | 67 |
|---|---|---|---|---|---|---|---|---|---|---|---|---|
| **Formulation Components** | | | | | | | | | | | | |
| Petroleum derived calcium sulfonate | 2.0 | 2.0 | 2.0 | 2.0 | 2.0 | 2.0 | 2.0 | 2.0 | 2.0 | 2.0 | 2.0 | 2.0 |
| Ethoylated fatty acid ester | 0.5 | 0.5 | 0.5 | 0.5 | 0.5 | 0.5 | 0.5 | 0.5 | 0.5 | 0.5 | 0.5 | 0.5 |
| Glycerol fatty acid ester | 0.25 | 0.25 | 0.25 | 0.25 | 0.25 | 0.25 | 0.25 | 0.25 | 0.25 | 0.25 | 0.25 | 0.25 |
| Molybdenum containing compounds | 0.0 | 0.2 | 0.5 | 1.0 | 0.0 | 0.2 | 0.5 | 1.0 | 0.0 | 0.2 | 0.5 | 1.0 |
| Mg sulfonate | 0.0 | 0.0 | 0.3 | 1.0 | 2.0 | 1.0 | 2.0 | 1.0 | 2.0 | 0.5 | 0.5 | 1.0 |
| Mg and/or Ca salicylates | 0.0 | 0.3 | 0.0 | 0.0 | 0.0 | 1.0 | 1.0 | 2.0 | 2.0 | 0.5 | 1.0 | 0.5 |
| Borated and/or non-borated succimidaes | 5.0 | 5.0 | 5.0 | 5.0 | 5.0 | 5.0 | 5.0 | 5.0 | 5.0 | 5.0 | 5.0 | 5.0 |
| Diaklyl or diaryl amines | 0.8 | 0.8 | 0.8 | 0.8 | 0.5 | 0.5 | 0.5 | 0.5 | 0.8 | 0.8 | 0.8 | 0.8 |
| Phenolic derivatives | 0.8 | 0.8 | 0.8 | 0.8 | 0.8 | 0.8 | 0.8 | 0.8 | 0.5 | 0.5 | 0.5 | 0.5 |
| Olefin-based polymers (block, star, and/or mixed) | 0.0 | 0.0 | 0.0 | 0.0 | 0.0 | 0.0 | 0.5 | 0.5 | 0.5 | 0.5 | 0.5 | 0.5 |
| Polymethacrylates | 0.3 | 0.3 | 0.3 | 0.3 | 0.3 | 0.3 | 0.1 | 0.1 | 0.1 | 0.1 | 0.1 | 0.1 |
| Fumnarate vinyl-acetate-based polymers | 0.1 | 0.1 | 0.1 | 0.1 | 0.1 | 0.1 | 0.3 | 0.3 | 0.3 | 0.3 | 0.3 | 0.3 |
| Zinc dialkyl dithiophosphate (1°, 2° and/or mixed) | 0.0 | 0.0 | 0.0 | 0.0 | 0.3 | 0.3 | 0.3 | 0.3 | 0.8 | 0.8 | 0.8 | 0.8 |
| Base Stocks (Group I, II, III, IV, V) | 95.4 | 94.9 | 94.6 | 93.4 | 93.3 | 93.1 | 91.8 | 86.3 | 84.8 | 87.6 | 86.8 | 86.3 |

METHOD FOR IMPROVING ENGINE FUEL EFFICIENCY

CROSS-REFERENCE TO RELATED APPLICATIONS

This application claims the benefit of U.S. Provisional Application No. 61/920,130 filed Dec. 23, 2013, herein incorporated by reference.

FIELD

This disclosure relates to improving fuel efficiency and friction reduction properties, while maintaining or improving deposit control, in an engine lubricated with a lubricating oil by including a combination of (i) a friction modifier mixture and (ii) a detergent in the lubricating oil.

BACKGROUND

Fuel efficiency requirements for passenger vehicles are becoming increasingly more stringent. New legislation in the United States and European Union within the past few years has set fuel economy and emissions targets not readily achievable with today's vehicle and lubricant technology.

To address these increasing standards, automotive original equipment manufacturers are demanding better fuel economy as a lubricant-related performance characteristic, while maintaining deposit control and oxidative stability requirements. One well known way to increase fuel economy is to decrease the viscosity of the lubricating oil. However, this approach is now reaching the limits of current equipment capabilities and specifications. At a given viscosity, it is well known that adding organic or organic metallic friction modifiers reduces the surface friction of the lubricating oil and allows for better fuel economy. However these additives often bring with them detrimental effects such as increased deposit formation, seals impacts, or they out-compete the anti-wear components for limited surface sites, thereby not allowing the formation of an anti-wear film, causing increased wear.

Contemporary lubricants such as engine oils use mixtures of additives such as dispersants, detergents, inhibitors, viscosity index improvers and the like to provide engine cleanliness and durability under a wide range of performance conditions of temperature, pressure, and lubricant service life.

Lubricant-related performance characteristics such as high temperature deposit control and fuel economy are extremely advantageous attributes as measured by a variety of bench and engine tests. As indicated above, it is known that adding organic friction modifiers to a lubricant formulation imparts frictional benefits at low temperatures, consequently improving the lubricant fuel economy performance. At high temperatures, however, adding increased levels of organic friction modifier can invite high temperature performance issues. For example, engine deposits are undesirable consequences of high levels of friction modifier in an engine oil formulation at high temperature engine operation.

A major challenge in engine oil formulation is simultaneously achieving high temperature deposit control while also achieving improved fuel economy.

Despite the advances in lubricant oil formulation technology, there exists a need for an engine oil lubricant that effectively improves fuel economy while maintaining or improving friction reduction properties and deposit control.

SUMMARY

This disclosure relates in part to a method for improving fuel efficiency and reducing frictional properties, while maintaining or improving deposit control, in an engine lubricated with a lubricating oil by including a unique combination of (i) a friction modifier mixture and (ii) a detergent in the lubricating oil. The lubricating oils of this disclosure are useful in internal combustion engines including direct injection, gasoline and diesel engines.

This disclosure also relates in part to a method for improving fuel efficiency and reducing frictional properties, while maintaining or improving deposit control, in an engine lubricated with a lubricating oil by using as the lubricating oil a formulated oil. The formulated oil has a composition comprising a lubricating oil base stock as a major component; and a combination of (i) a friction modifier mixture comprising a first friction modifier, and at least one other friction modifier different from said first friction modifier, and (ii) a detergent, as a minor component. The first friction modifier and the at least one other friction modifier are selected from the group consisting of an alkoxylated fatty acid ester, alkanolamide, polyol fatty acid ester, borated glycerol fatty acid ester, and fatty alcohol ether. The detergent comprises a petroleum derived calcium sulfonate. Fuel efficiency and friction reduction properties are improved and deposit control is maintained or improved as compared to friction reduction properties and deposit control achieved using a lubricating engine oil containing a minor component other than the combination of the friction modifier mixture and detergent.

This disclosure further relates in part to a lubricating engine oil having a composition comprising a lubricating oil base stock as a major component; and a combination of (i) a friction modifier mixture comprising a first friction modifier, and at least one other friction modifier different from said first friction modifier, and (ii) a detergent, as a minor component. The first friction modifier and the at least one other friction modifier are selected from the group consisting of an alkoxylated fatty acid ester, alkanolamide, polyol fatty acid ester, borated glycerol fatty acid ester, and fatty alcohol ether. The detergent comprises a petroleum derived calcium sulfonate. Fuel efficiency and friction reduction properties are improved and deposit control is maintained or improved as compared to friction reduction properties and deposit control achieved using a lubricating engine oil containing a minor component other than the combination of the friction modifier mixture and detergent.

It has been surprisingly found that, in accordance with this disclosure, improvements in fuel economy and friction reduction properties are obtained without sacrificing engine cleaniness (e.g., while maintaining or improving deposit control) in an engine lubricated with a lubricating oil, by including a unique combination of (i) a friction modifier mixture and (ii) a detergent in the lubricating oil.

Other objects and advantages of the present disclosure will become apparent from the detailed description that follows.

BRIEF DESCRIPTION OF THE DRAWINGS

FIG. 1 shows formulation embodiments of this disclosure, in particular, individual contributions of components to a baseline formulation used in the Examples.

FIG. 2 shows formulation embodiments of this disclosure. Formulation details are shown in weight percent based on the total weight percent of the formulation, of various formulations. FIG. 2 also shows the results of testing of the formulations.

FIG. 3 shows a comparison of formulation embodiments of this disclosure and decreased treat rate formulations set forth in the Examples.

FIG. 4 shows a comparison of formulation embodiments of this disclosure and other detergents (i.e., a synthetic calcium sulfonate detergent) used in the Examples.

FIG. 5 shows a comparison of formulation embodiments of this disclosure including various friction modifiers and detergents used in the Examples.

FIG. 6 shows a comparison of formulation embodiments of this disclosure including various antioxidants used in the Examples.

FIG. 8 shows a comparison of formulation embodiments of this disclosure and other base stock oils used in the Examples.

FIG. 9 shows formulation embodiments of this disclosure. FIG. 9 also shows the results of testing of the formulations.

FIG. 10 depicts other exemplary lubricant formulations of the present disclosure with individual contributions of components used in such formulations.

FIG. 11 depicts still other exemplary formulations of the present disclosure with individual contributions of components used in such formulations.

FIG. 12 depicts still yet other exemplary formulations of the present disclosure with individual contributions of components used in such formulations.

DETAILED DESCRIPTION

Figure 7:
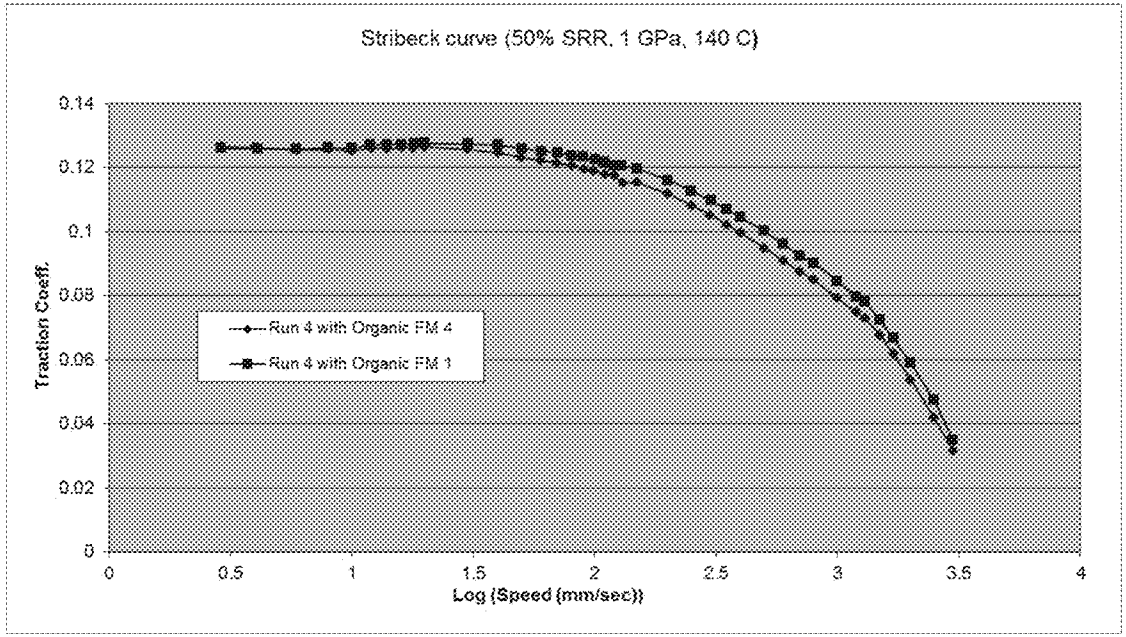
FIG. 7 graphically shows average integrated Stribeck friction coefficients from mini-traction machine (MTM) measurements performed at 140° C. for lubricating oils containing Organic Metallic FM 1 (i.e., a molybdenum diamine) and Organic Metallic FM 4 (i.e., a molybdenum dithiocarbamate).

All numerical values within the detailed description and the claims herein are modified by "about" or "approximately" the indicated value, and take into account experimental error and variations that would be expected by a person having ordinary skill in the art.

It has now been found that improved fuel efficiency and friction reduction properties can be attained, while deposit control is unexpectedly maintained or improved, in an engine lubricated with a lubricating oil by using as the lubricating oil a formulated oil that has a unique combination of (i) a friction modifier mixture and (ii) a detergent. The formulated oil preferably comprises a lubricating oil base stock as a major component, and a combination of (i) a friction modifier mixture and (ii) a detergent, as a minor component, and optionally other additives such as a metal dialkyl dithiio phosphate, and a viscosity index improver. The lubricating oils of this disclosure are particularly advantageous as passenger vehicle engine oil (PVEO) products.

The lubricating oils of this disclosure provide excellent engine protection including engine cleanliness and anti-wear performance. This benefit has been demonstrated for the lubricating oils of this disclosure in the Sequence IIIG (ASTM D7320) engine test. The lubricating oils of this disclosure provide improved fuel efficiency. A lower HTHS viscosity engine oil generally provides superior fuel economy to a higher HTHS viscosity product. This benefit has been demonstrated for the lubricating oils of this disclosure in the Sequence VID Fuel Economy (ASTM D7589) engine test.

The lubricating engine oils of this disclosure have a composition sufficient to pass wear protection requirements of one or more engine tests selected from Sequence IIIG and others.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_6$, $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_6$ to $C_{16}$ alphaolefins, such as 1-hexene, 1-octene, 1-decene, 1-dodecene and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to 100 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of 3 cSt to 50 cSt, preferably 3 cSt to 30 cSt, more preferably 3.5 cSt to 25 cSt, as exemplified by GTL 4 with kinematic viscosity of 4.0 cSt at 100° C. and a viscosity index of 141. These Gas-to-Liquids (GTL) base oils. Fischer-Tropsch wax derived base oils, and other wax-derived hydroisomerized base oils may have useful pour points of −20° C. or lower, and under some conditions may have advantageous pour points of −25° C. or lower, with useful pour points of −30° C. to −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%/o, and more preferably 4% to 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than 70 weight percent, preferably more than 80 weight percent and most preferably more than 90 weight percent. Renewable esters can be preferred in combination with the friction modifier mixture and detergent of this disclosure.

Other useful fluids of lubricating viscosity include non-conventional or unconventional base stocks that have been processed, preferably catalytically, or synthesized to provide high performance lubrication characteristics.

Non-conventional or unconventional base stocksibase oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates), preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from 50 to 99 weight percent, preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or $mm^2/s$) at 100° C. Mixtures of synthetic and natural base oils may be used if desired. Mixtures of Group III, IV, V may be preferable.

Friction Modifier Mixtures

Friction modifier mixtures useful in this disclosure are any materials that can alter the coefficient of friction of a surface lubricated by any lubricant or fluid containing such material(s). Mixtures of friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. Friction modifier mixtures that lower the coefficient of friction are particularly advantageous in combination with the base oils and lube compositions of this disclosure.

Illustrative friction modifier mixtures useful in the lubricating engine oil formulations of this disclosure include, for example, a first friction modifier, and at least one other friction modifier different from said first friction modifier. The first friction modifier and the at least one other friction modifier are selected from the group consisting of an alkoxylated fatty acid ester, alkanolamide, polyol fatty acid ester, borated glycerol fatty acid ester, and fatty alcohol ether.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides.

Illustrative polyol fatty acid esters include, for example, glycerol mono-oleate, saturated mono-, di, and tri-glyceride esters, glycerol mono-stearate, and the like. These can include polyol esters and hydroxyl-containing polyol esters. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol mono-oleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative borated glycerol fatty acid esters include, for example, borated glycerol mono-oleate, borated saturated mono-, di, and tri-glyceride esters, borated glycerol monostearate, and the like.

Illustrative fatty alcohol ethers include, for example, stearyl ether, myristyl ether, and the like. Alcohols, including those that have carbon numbers from $C_3$ to $C_{50}$, can be ethoxylated, propoxylate, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

A preferred friction modifier mixture of this disclosure comprises an ethoxylated fatty acid ester and a glycerol fatty acid ester. A preferred formulation of this disclosure comprises a lubricating oil base stock that includes a Group I, Group II, Group III, Group IV and/or Group V base oil and a friction modifier mixture that includes an ethoxylated fatty acid ester and a glycerol fatty acid ester.

Useful concentrations of friction modifier mixtures may range from 0.01 weight percent to 10-15 weight percent or more, often with a preferred range of 0.1 weight percent to 5 weight percent, or 0.1 weight percent to 2.5 weight percent, or 0.1 weight percent to 1.5 weight percent, or 0.1 weight percent to 1 weight percent. The weight ratio of the first friction modifier to the other friction modifier can range from 0.1:1 to 1:0.1.

Detergents

Illustrative detergents useful in combination with the friction modifier mixture of this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

Illustrative detergents include calcium sulfonates, magnesium sulfonates, calcium salicylates, magnesium salicylates, calcium phenates, magnesium phenates and other related components (including borated detergents), and mixtures thereof. Preferred detergents include calcium sulfonate, magnesium sulfonate and calcium salicylate. A petroleum derived calcium sulfonate is the preferred detergent for use in combination with the friction modifier mixture.

The detergent concentration in the lubricating oils of this disclosure can range from 0.01 to 6.0 weight percent, preferably 0.01 to 5.0 weight percent, and more preferably from 2.0 weight percent to 4.0 weight percent, based on the total weight of the lubricating oil.

As used herein, the detergent concentrations are given on an "as delivered" basis. Typically, the active detergent is delivered with a process oil. The "as delivered" detergent typically contains from 20 weight percent to 80 weight percent, or from 40 weight percent to 60 weight percent, of active detergent in the "as delivered" detergent product.

Other Additives

The formulated lubricating oil useful in the present disclosure may additionally contain one or more of the other commonly used lubricating oil performance additives including but not limited to antiwear agents, dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, metal-containing organic complex friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Antiwear Additive

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from 0.4 weight percent to 1.2 weight percent, preferably from 0.5 weight percent to 1.0 weight percent, and more preferably from 0.6 weight percent to 0.8 weight percent, based on the total weight of the lubricating oil, although more or less can often be used advantageously. Preferably, the ZDDP is a secondary ZDDP and present in an amount of from 0.6 to 1.0 weight percent of the total weight of the lubricating oil.

Low phosphorus engine oil formulations are included in this disclosure. For such formulations, the phosphorus content is typically less than 0.12 weight percent preferably less than 0.10 weight percent and most preferably less than 0.085 weight percent. Low phosphorus can be preferred in combination with the friction modifier mixture and detergent.

Viscosity Index Improvers

Viscosity index improvers (also known as VI improvers, viscosity modifiers, and viscosity improvers) can be included in the lubricant compositions of this disclosure.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than 2.0 weight percent, preferably less than 1.0 weight percent, and more preferably less than 0.5 weight percent, based on the total weight of the formulated oil or lubricating engine oil. Viscosity improvers are typically added as concentrates, in large amounts of diluent oil.

In another embodiment of this disclosure, the viscosity index improvers may be used in an amount of from 0.25 to 2.0 weight percent, preferably 0.15 to 1.0 weight percent, and more preferably 0.05 to 0.5 weight percent, based on the total weight of the formulated oil or lubricating engine oil.

Other Detergents

Illustrative other detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of other detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as other detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

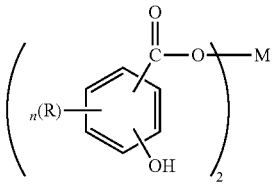

where R is an alkyl group having 1 to 30 carbon atoms, n is an integer from 1 to 4, and M is an alkaline earth metal. Preferred R groups are alkyl chains of at least ($C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as other detergents and are known in the art.

The other detergents may be simple detergents or what is known as hybrid or complex detergents. The latter detergents can provide the properties of two detergents without the need to blend separate materials. See U.S. Pat. No. 6,034,039.

Preferred other detergents include calcium phenates, calcium sulfonates, calcium salicylates, magnesium phenates, magnesium sulfonates, magnesium salicylates and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

The other detergent concentration in the lubricating oils of this disclosure can range from 0.01 to 6.0 weight percent, preferably 0.01 to 5.0 weight percent, and more preferably from 2.0 weight percent to 4.0 weight percent, based on the total weight of the lubricating oil.

As used herein, the other detergent concentrations are given on an "as delivered" basis. Typically, the active detergent is delivered with a process oil. The "as delivered" detergent typically contains from 20 weight percent to 80 weight percent, or from 40 weight percent to 60 weight percent, of active detergent in the "as delivered" detergent product.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful, although on occasion, having a hydrocarbon substituent between 20-50 carbon atoms can be useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HN®_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000, or from 1000 to 3000, or 1000 to 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components. Such additives may be used in an amount of 0.1 to 20 weight percent, preferably 0.5 to 8 weight percent, or more preferably 0.5 to 4 weight percent. On an active ingredient basis, such additives may be used in an amount of 0.06 to 14 weight percent, preferably 0.3 to 6 weight percent. The hydrocarbon portion of the dispersant atoms can range from $C_{60}$ to $C_{400}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates.

As used herein, the dispersant concentrations are given on an "as delivered" basis. Typically, the active dispersant is delivered with a process oil. The "as delivered" dispersant typically contains from 20 weight percent to 80 weight percent, or from 40 weight percent to 60 weight percent, of active dispersant in the "as delivered" dispersant product.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of 0.01 to 5 weight percent, preferably 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, alkoxysulfolanes ($C_{10}$ alcohol, for example), aromatic esters, aromatic hydrocarbons, esters (butylbenzyl phthalate, for example), and polybutenyl succinic anhydride. Such additives may be used in an amount of 0.01 to 3 weight percent, preferably 0.01 to 2 weight percent.

Antifoam Agents

Antifoam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 weight percent, preferably 0.01 to 1.5 weight percent.

Metal-Containing Organic Complex Friction Modifiers

In addition to the friction modifier mixtures used in the lubricating engine oil formulations of this disclosure, metal-containing organic complex friction modifiers may also be used. Metal-containing organic complex friction modifiers useful in this disclosure are any materials that can alter the coefficient of friction of a surface lubricated by any lubricant or fluid containing such material(s). Metal-containing organic complex friction modifiers, also known as friction reducers, or lubricity agents or oiliness agents, and other such agents that change the ability of base oils, formulated lubricant compositions, or functional fluids, to modify the coefficient of friction of a lubricated surface can be effectively used in combination with the base oils or lubricant compositions of the present disclosure. Metal-containing organic complex friction modifiers that lower the coefficient of friction are particularly advantageous in combination with the base oils and lube compositions of this disclosure.

Illustrative metal-containing organic complex friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like. Similar tungsten based compounds may be preferable. Useful concentrations of the metal-containing organic complex friction modifiers may range from 0.01 weight percent to 5 weight percent, or 0.1 weight percent to 2.5 weight percent. Useful concentration of molybdenum can range from 25 to 700 ppm, or more preferably from 50 to 200 ppm.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %/o) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.1-2 | 0.1-1 |
| Anti-wear | 0.1-2 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

Examples

The detergents used in the formulations were a petroleum derived calcium sulfonate (Detergent 1), a synthetic calcium sulfonate (Detergent 2), a low base calcium salicylate (Detergent 3), a mixed calcium salicylate (Detergent 4), and a magnesium sulfonate.

The friction modifiers used in the formulations included organic friction modifiers and organic metallic friction modifiers. The organic friction modifiers were an ethoxylated fatty ester (Organic FM 1), an alkanolamide (Organic FM 2), a borated glycerol mono-oleate (Organic FM 3), a stearyl ether (Organic FM 4), and a mixture of saturated mono-, di-, and tri-glyceride esters (Organic FM 5). The organic metallic friction modifiers were a molybdenum complex containing diamine and ester species (Organic Metallic FM 1), an organotungstenate (Organic Metallic FM 2), a different organotungstenate (Organic Metallic FM 3), and a molybdenum dithiocarbamate (Organic Metallic FM 4).

The antioxidants used in the formulations were a phenolic alkylene oxide (Antioxidant 1), a different phenolic alkylene oxide (Antioxidant 2), and a diphenyl amine (Antioxidant 3).

Bench testing was conducted for formulations of this disclosure. The bench testing included the following: kinematic viscosity (KV) at 100° C. measured by ASTM D445; integrated mini traction machine (MTM) friction at 140° C. as described below; and thermo-oxidation engine oil simulation testing (TEOST 33C-SAE 932837 and SAE 962039). For some formulations, the bench testing included high temperature high shear (HTHS) viscosity at 150° C. measured by ASTM D4683.

The Mini Traction Machine (MTM) is a fully automated instrument manufactured by PCS Instruments and identified as Model MTM. The test specimens and apparatus configuration are such that realistic pressure, temperature and speed can be attained without requiring very large loads, motors or structures. A small sample of fluid (50 milliliters) is placed in a test cell and the machine automatically runs either through a range of speeds, slide-to-roll ratios, temperatures and loads, or at specifically set temperature, slide-to-roll ratio and speed range to generate information regarding the friction performance of a test fluid without further operator intervention. The working of the MTM is known and familiar to those of skill in the art.

In order to allow for numerical comparison of the MTM Stribeck traces, an integration method (the trapezoidal rule) was employed for each curve individually and an average integrated Stribeck friction coefficient and standard deviation for all 4 traces were calculated. The average integrated Stribeck friction coefficient provides a measure of the friction an engine will see during operation (albeit at different ratios to those calculated). The MTM integrated area value listed throughout this disclosure has been calculated using this method.

PCMO (passenger car motor oil) formulations were prepared including baseline formulations. FIG. 1 outlines the benefits and detriments for individual components, and provides the baseline data for the unique chemistries in accordance with this disclosure.

FIG. 1 shows individual contributions of components in Comparative Examples 1-12 to a baseline formulation, Baseline 1. Baseline 1 has only a mixed calcium salicylate detergent (Detergent 4) in its formulation. There are no other detergents or friction modifiers present in this formulation. Going from left to right, 1% of each of the detergents and friction modifiers are added to the baseline formulation to gauge their impact on the overall friction and deposits compared to the baseline formulation. Comparative Example 1 shows a petroleum derived calcium sulfonate detergent (Detergent 1) provides equivalent friction to that of Baseline 1, but with improved deposit performance. The ethoxylated fatty ester friction modifier (Organic FM 1) results in Comparative Example 4 showing equivalent deposit control to that of Baseline 1 and slightly reduced friction. At the same time, another organic friction modifier, a borated glycerol mono-oleate (Organic FM 3), in Comparative Example 6 shows lower deposits and equivalent friction compared to that of Baseline 1.

While none of the individual components provide a significant change from the baseline for both friction reduction and deposit control, the combination of the detergent and the organic friction modifier mixture yields an unexpected benefit in both friction and deposits, as shown in FIG. 2 for Inventive Examples 1-4. The deposit result from the TEOST 33C bench test for these Inventive Examples is equivalent or improved compared to the benefit from any individual component, but with the additional benefit of reduced friction than what was seen in the Comparative Examples in FIG. 1. FIG. 2 shows the TEOST 33C and MTM data for these formulations compared to Baselines 1 and 2, where Baseline 2 is a comparable formulation to the Inventive Examples and contains other organic and organic metallic friction modifiers. Clearly, the unique combination of detergent and friction modifier mixture in the Inventive Examples highlights an unexpected combination of desirable deposit control and excellent friction reduction. Additional work was done with this formulation to determine the desired treat rates of each component. The results of this investigation are also included in FIG. 2.

Referring to FIG. 2, starting from the left, Baselines 1 and 2 are provided for reference, while Inventive Example 1 is one example of a preferred formulation, showing the low MTM friction and good deposit control in the TEOST 33C. Inventive Example 2 shows similar excellent friction reduction and better deposit control at a lower concentration level of Organic Metallic FM 4. Inventive Example 3 shows a formulation with the preferred additive combination and a different molybdenum FM (Organic Metallic FM 1). This combination also provides the good deposit control and low frictional performance seen in the other Inventive Examples. Inventive Example 4 shows that additional salicylate detergent (Detergent 3) in combination with the preferred additive combination still provides favorable frictional and deposit performance. Comparative Example 13 shows that the removal of Organic FM 3 from the formulation negatively impacts the frictional performance and causes increased deposits. Comparative Example 14 shows that there is a balance for the deposit control in the unique composition, as an increase in Detergent 1 (at a constant ash) led to a significant increase in deposits. Comparative Examples 15 and 16 show the importance of Detergent 1 in the Inventive Examples as the deposits are significantly increased when Detergent 1 is replaced by Detergent 3.

The results in FIG. 2 show a unique combination of Organic FM 1, Organic FM 3, and Detergent 1 which provide unexpected frictional reduction and excellent deposit control. Removing Organic FM 3 from the formulation in Comparative Example 13 increased both friction and deposits. When 2% and 5% of Detergent 3 were introduced individually into different formulations (Comparative Examples 15 and 16), there was a slight friction reduction and a large increase in deposits. This highlights the importance of Detergent 1 in the preferred combination. Additional formulations investigated similar chemistry combinations, but showed signs of storage stability concerns when blended. The data evidences a unique synergy present when Detergent 1, Organic FM 1, Organic FM 3, and an organic metallic friction modifier (i.e., Organic Metallic FM 1) are used in combination with each other.

Additional bench and engine testing data were developed for the chemistry in Inventive Example 3, which continued to show the excellent frictional and deposit properties seen in the earlier testing. FIG. 3 shows a comparison of Inventive Example 3 and the decreased treat rate formulation, Inventive Example 5.

As shown in FIG. 3, Inventive Example 5 had similarly favorable deposit performance as Inventive Example 3, but the integrated friction was approximately twice that of Inventive Example 3. Although the increased frictional performance in Inventive Example 5 is less favorable, the overall frictional performance is still significantly lower than that of Baselines 1 and 2 or many other Comparative Examples. When Inventive Example 5 was run in the TEOST 33C deposits test, the results were once again surprising, as excellent deposit protection was observed. As a result of the outstanding bench test deposit result, the industry standard Sequence IIIG engine test was conducted on Inventive Example 5. Once again, the weighted piston deposits (WPD), which is a measure of the deposits formed on the different areas of a piston and is measured in merits, meaning a higher WPD is desirable, showed excellent results. A WPD of 5.6 was attained for this formulation vs. a WPD of 4.3 for Baseline 2. This formulation was also run in the Sequence VID engine test to measure the fuel economy improvement. The fuel economy sum, which the fresh oil fuel economy and the used oil fuel economy, for this formulation was 4.1%. Compared to the FEI Sum of 2.9% for Baseline 2, this is a significant improvement.

Use of Detergent 2 in Place of Detergent 1

As FIG. 4 shows, using Detergent 2 in place of Detergent 1 can have similar deposit improvement results. However, unlike in the Inventive Examples, a reduction in frictional performance is not seen with Detergent 2. The difference in viscosity grade between the two formulations is a result of the viscosity modifier (VM) treat rate. Increasing VM concentration in going from a SAE 0W-16 for Baseline 3 to a SAE 0W-20 for Comparative Example 17 is expected to have a negative impact on deposits. When a 0.75% treat of Detergent 2 is added for Comparative Example 17, the results show a reduction in deposits. While Baseline 3 provided a IIIG WPD rating of 4.3, the addition of Detergent 2 provided additional cleaning benefit and yielded a IIIG WPD rating of 5.8.

Impact of Detergent 1

The combination of Detergent 1 with Organic FM 3 and Organic FM 5 led to a significantly low TEOST 33C performance along with exceptional frictional benefit in the MTM. As shown in FIG. 5, the favorable TEOST 33C performance is a function of Detergent 1 rather than a function of either organic FM for blends at a constant ash.

Antioxidant Changes

As shown in FIG. 6, Comparative Examples 21-23, the presence or specific structure of a phenolic antioxidant does not impact the MTM friction of the blended oil nor TEOST 33C performance, as the integrated MTM friction and TEOST 33C results are equivalent for the blends with Antioxidant 1, Antioxidant 2, and with no antioxidant.

Use of Organic Metallic FM 1 or Organic Metallic FM 4

Alternate chemistries such as Organic Metallic FM 1, containing no phosphorous or sulfur in its chemical composition, may provide similar excellent friction performance but yield lower or equivalent deposits than the baseline formulation. Organic Metallic FM 1 was blended into the baseline formulation and compared to Organic Metallic FM 4 at equivalent metal elemental content, all other components being held constant. The resulting oils were compared using MTM Stribeck friction measurements, as shown in FIG. 7. Deposit testing yielded very good and equivalent results of 18 mg for FM 4 and FM 1, respectively. Therefore, Organic Metallic FM 1 and Organic Metallic FM 4 are considered equivalent and desirable for this disclosure.

Group III Basestock Interchange

High quality Group III basestocks, including GTL, are considered interchangeable and desirable for the purposes of this disclosure. As such, exchanging Group IIIA and Group IIIB is expected to have minimal viscometric impact on the formulations and no impact in terms of cleanliness performance, fuel economy, or efficacy of the additives. The data in FIG. 8, Comparative Examples 24-25, in which a comparison of kinematic viscosity at 100° C., MTM friction at 140 t, and TEOST 33C results for two oils where the Group IIIA is exchanged for Group IIIB is shown, confirms the equivalent and very good performance. For this reason, Group IIIA and Group IIIB can be used interchangeably in these formulations.

Treat Rates of Organic Friction Modifiers and Detergents

Additional work was done with this formulation to determine the desired treat rates of each component. The results of this investigation are also included in FIG. 9.

Referring to FIG. 9, starting from the left, Inventive Example 1, having one example of the preferred formulation, is provided for reference, showing the low MTM friction and good deposit control in the TEOST 33C. The relevant changes in weight percent for the organic friction modifiers and the detergents have been bolded to highlight the data supporting desired low friction (low MTM results) and low deposits (low TEOST 33C results). As shown in FIG. 9, amounts of Detergent 1 at 1.0 weight percent and 3.0 weight percent show desired low friction and low deposits. In comparison, amounts of Detergent 1 at 0.5 weight percent show less desired higher friction and higher deposits. In line with the previous results shown in FIG. 4, Detergent 2 at 1.0 weight percent and 3.0 weight percent show undesired high friction compared to the blends with Detergent 1. As further shown in FIG. 9, amounts of Organic FM 1 at 0.25 weight percent and 0.75 weight percent show desired low friction and low deposits. In comparison, amounts of Organic FM 1 at 0.1 weight percent show higher friction. As yet further shown in FIG. 9, amounts of Organic FM 3 at 0.1 weight percent show desired low friction and low deposits. In comparison, amounts of Organic FM 3 at 0.5 weight percent and 0.75 weight percent show undesired higher friction.

The results in FIG. 9 show desired amounts of the combination of Organic FM 1, Organic FM 3, and Detergent 1 in the lubricating oils of this disclosure. This combination provides the desired deposit control and frictional performance. In accordance with this disclosure, desired deposit control (as determined by TEOST 33C) is below 20 mg, preferably below 17.5 mg, and more preferably below 15 mg. Also, in accordance with this disclosure, desired frictional performance (as determined by MTM) is below 0.15, preferably below 0.125, and more preferably below 0.10.

Other Exemplary Formulations

The lubricating engine oil formulations in FIG. 10 are combinations of additives and base stocks and are expected to have a kinematic viscosity at 100° C. about 6 $mm^2/s$ and an HTHS viscosity at 150° C. about 2.0 cP. The lubricating engine oil formulations in Examples 32-35 are expected to have a phosphorous level about 0 ppm. The lubricating engine oil formulations in Examples 36-39 are expected to have a phosphorous level about 300 ppm. The lubricating engine oil formulations in Examples 40-43 are expected to have a phosphorous level of about 700 ppm. The lubricating engine oils in Examples 32-34 are expected to have a sulfated ash level (measured by ASTM D874) around 0.3 weight percent and a total base number (measured by ASTM D2896) about 4. The lubricating engine oils in Examples 35-43 are expected to have a sulfated ash level (measured by ASTM D874) greater than or equal to 1.0 weight percent and a total base number (measured by ASTM D2896) greater than or equal to 9. The lubricating engine oil formulations in Examples 32, 36, and 40 do not contain molybdenum. The lubricating engine oil formulations in Examples 33, 37, and 41 are expected to have molybdenum levels about 90 ppm. The lubricating engine oil formulations in Examples 34, 38, and 42 are expected to have molybdenum levels about 250 ppm. The lubricating engine oil formulations in Examples 35, 39, and 43 are expected to have molybdenum levels about 500 ppm.

The lubricating engine oil formulations in FIG. 11 are combinations of additives and base stocks and are expected to have a kinematic viscosity at 100° C. about 5 $mm^2/s$ and an HTHS viscosity at 150° C. about 1.7 cP. The lubricating engine oil formulations in Examples 44-47 are expected to have a phosphorous level about 0 ppm. The lubricating engine oil formulations in Examples 48-51 are expected to have a phosphorous level about 300 ppm. The lubricating engine oil formulations in Examples 52-55 are expected to have a phosphorous level about 700 ppm. The lubricating engine oils in Examples 44-46 are expected to have a sulfated ash level (measured by ASTM D874) about 0.3 weight percent and a total base number (measured by ASTM D2896) about 4. The lubricating engine oils in Examples 47-55 are expected to have a sulfated ash level (measured by ASTM D874) greater than or equal to 1.0 weight percent and a total base number (measured by ASTM D2896) greater than or equal to 9. The lubricating engine oil formulations in Examples 44, 48, and 52 do not contain molybdenum. The lubricating engine oil formulations in Examples 45, 49, and 53 are expected to have molybdenum levels about 90 ppm. The lubricating engine oil formulations in Examples 46, 50, and 54 are expected to have molybdenum levels about 250 ppm. The lubricating engine oil formulations in Examples 47, 51, and 55 are expected to have molybdenum levels about 500 ppm.

The lubricating engine oil formulations in FIG. 12 are combinations of additives and base stocks and are expected to have a kinematic viscosity at 100° C. about 4 $mm^2/s$ and an HTHS viscosity at 150° C. about 1.4 cP. The lubricating engine oil formulations in Examples 56-59 are expected to have a phosphorous level about 0 ppm. The lubricating engine oil formulations in Examples 60-63 are expected to have a phosphorous level about 300 ppm. The lubricating engine oil formulations in Examples 64-67 are expected to have a phosphorous level about 700 ppm. The lubricating engine oils in Examples 56-58 are expected to have a sulfated ash level (measured by ASTM D874) about 0.3 weight percent and a total base number (measured by ASTM D2896) about 4. The lubricating engine oils in Examples 59-67 are expected to have a sulfated ash level (measured by ASTM D874) greater than or equal to 1.0 weight percent and a total base number (measured by ASTM D2896) greater than or equal to 9. The lubricating engine oil formulations in Examples 56, 60, and 64 do not contain molybdenum. The lubricating engine oil formulations in Examples 57, 61, and 65 are expected to have molybdenum levels about 90 ppm. The lubricating engine oil formulations in Examples 58, 62, and 66 are expected to have molybdenum levels about 250 ppm. The lubricating engine oil formulations in Examples 59, 63, and 67 are expected to have molybdenum levels about 500 ppm.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for improving fuel efficiency and reducing frictional properties, while maintaining or improving deposit control, in an engine lubricated with a lubricating oil by using as the lubricating oil a formulated oil, said formulated oil having a composition comprising a lubricating oil base stock comprising a mixture of Group III, Group IV and Group V base oils at from 84.01 to 85.51 wt. % of the formulated oil; and a combination of (i) a friction modifier mixture comprising 0.25 to 0.75 wt. % ethoxylated fatty ester friction modifier, and 0.1 to 0.25 wt. % borated glycerol mono-oleate friction modifier, and (ii) a detergent mixture comprising 1.0 to 3.0 wt. % petroleum derived calcium sulfonate and 2.5 to 3.0 wt % mixed calcium salicylate; and wherein deposit control (as determined by TEOST 33C-SAE 932837 and SAE 962039) is less than or equal to 16 mg, and frictional performance (as determined by MTM at 140° C.) is less than or equal to 0.113.

2. A lubricating engine oil having a composition comprising a lubricating oil base stock comprising a mixture of Group III, Group IV and Group V base oils at from 84.01 to 85.51 wt. % of the formulated oil; and a combination of (i) a friction modifier mixture comprising 0.25 to 0.75 wt. % ethoxylated fatty ester friction modifier, and 0.1 to 0.25 wt. % borated glycerol mono-oleate friction modifier, and (ii) a detergent mixture comprising 1.0 to 3.0 wt. % petroleum derived calcium sulfonate and 2.5 to 3.0 wt % mixed calcium salicylate;

wherein deposit control (as determined by TEOST 33C-SAE 932837 and SAE 962039) is less than or e to 16 mg, and frictional performance (as determined by MTM at 140° C.) is less than or equal to 0.113.

3. The lubricating engine oil of claim 2 wherein the lubricating oil further comprises one or more of an anti-wear additive, viscosity index improver, antioxidant, detergent, dispersant, pour point depressant, corrosion inhibitor, metal deactivator, seal compatibility additive, anti-foam agent, inhibitor, anti-rust additive, and a metal-containing organic complex friction modifier.

4. The lubricating engine oil of claim 2 wherein the lubricating oil is a passenger vehicle engine oil (PVEO).

* * * * *